US006508315B1

(12) United States Patent
Lindsay

(10) Patent No.: US 6,508,315 B1
(45) Date of Patent: Jan. 21, 2003

(54) SMALL IMPACT POWER TOOL

(76) Inventor: Steven James Lindsay, 3714 W. Cedar Hills Dr., Kearney, NE (US) 68845

( * ) Notice: Subject to any disclaimer, the term of this patent is extended or adjusted under 35 U.S.C. 154(b) by 41 days.

(21) Appl. No.: 09/876,434

(22) Filed: Jun. 7, 2001

(51) Int. Cl.[7] ..... B25D 9/14

(52) U.S. Cl. ..... 173/115; 173/132; 173/200; 173/206

(58) Field of Search ..... 173/206, 207, 173/115, 128, 169, 13, 132, 200, 122, 120; 279/75

(56) References Cited

U.S. PATENT DOCUMENTS

| | | | | |
|---|---|---|---|---|
| 3,393,755 A | | 7/1968 | Glaser et al. | |
| 4,030,556 A | | 6/1977 | Phillips | |
| 4,416,338 A | * | 11/1983 | Nelson et al. | 173/169 |
| 4,502,824 A | * | 3/1985 | Dohse et al. | 173/206 |
| 4,694,912 A | | 9/1987 | Glaser | |
| 4,903,784 A | | 2/1990 | Glaser | |
| 5,203,417 A | | 4/1993 | Glaser | |
| 5,449,044 A | | 9/1995 | Phillips | |
| 5,515,930 A | | 5/1996 | Glaser | |
| 5,803,183 A | | 9/1998 | Phillips | |
| 6,021,574 A | | 2/2000 | Murray | |
| 6,085,850 A | | 7/2000 | Phillips | |
| 6,095,256 A | | 8/2000 | Lindsay | |

OTHER PUBLICATIONS

Author: Glendo Cooperation, Title: "GRS Tools 901 Handpiece" (Owner's Manual), Date: Mar. 2001, Published: in USA, Pertinent page is p. 3 containing a parts list and exploded drawing. Pertinent part numbers on p. 3 are: 004–407 (anvil), 002–948 (O–Ring).

Owner's manual titled: "Air Graver Instructions", published by Danville Engineering, Inc. publish date: Before May 14, 1996.

Copy of photograph taken of disassemble "Air Graver" made by Danville Engineering, Inc.

Copy of cover and p. 165 of catalog titled "1995 1996 Brownells" published by Brownells, Inc. 1995.

* cited by examiner

*Primary Examiner*—Scott A. Smith

(57) ABSTRACT

A hand-held pneumatic impact tool for use in fine hand working operations includes a mechanism for adjusting impacting characteristics of the device that is conveniently located and adjusted by the user. The mechanism includes an annular band protruding around the outside diameter of the body of the impact tool that may be turned for adjusting the piston stroke length and speed at which impacts occur.

15 Claims, 4 Drawing Sheets

SMALL IMPACT POWER TOOL

BACKGROUND OF THE INVENTION—Field of Invention

The present invention relates to impact power tools and, more particularly, to an improved hand-held impact power tool for delicate hand engraving and stone setting in the hand engraving and jewelry fields.

BACKGROUND OF THE INVENTION—Description of Prior Art

An impact power tool is known from my earlier U.S. Pat. No. 6,095,256, to Lindsay, which may be used for engraving, carving and delicate stone setting operations.

Although the known impact power tool mentioned above provides improved control of delicate hand-working operations not previously available, it would be desirable to provide an impact tool with a feature that will provide greater ease of use. A known embodiment disclosed in my earlier U.S. Pat. No. 6,095,256, to Lindsay, uses a feature to adjust the impacting characteristics of the tool. This feature is beneficial to users, however modifying this impacting adjustment takes valuable time from the jeweler or engraver, as two setscrews need to be loosened before the user can begin to adjust the tool. The feature utilized the end of a screw for the impact location within the bore of the tool. When the user adjusts this screw and thus the location of impacts, it allows the piston to enter into the front chamber letting more or less exhaust be released. It allowed more or less air pressure stored in the rear chamber to pass through the piston to the front chamber and to the atmosphere. When more air pressure was relieved from the rear chamber the piston was allowed to make a longer return stroke and thus harder impacts in the forward stroke. If this feature could adjust a floating tool holder or anvil with a rotating barrel on the outside of the handpiece it would make the impact tool more user friendly.

Floating tool holders and anvils in hand held impact power tools are not new. U.S. Pat. Nos. 6,085,850, 5,803,183, 5,449,044, and 4,030,556, all to Phillips, utilize rubber o-rings to float an anvil that attaches to a tool holder. U.S. Pat. No. 6,021,574, to Murray, utilizes rubber o-rings to float a tool holder. Owner's manual titled *GRS Tools* 901 *Handpiece* written by Glendo Cooperation, page 3, depicts an impact tool using o-rings to float an anvil. O-rings used in these configurations will return the tool holder or anvil to its original location after each impact or blow of the piston. What is needed to construct a more user friendly length of stroke adjustment than what is depicted in my earlier impact tool U.S. Pat. No. 6,095,256 is a way for the user to manually, yet quickly, adjust the anvil and/or tool holder and thus alter the impacting location.

OBJECTS AND SUMMARY OF THE INVENTION

In my earlier invention U.S. Pat. No. 6,095,256, an impact tool was depicted with a manual adjusting length and speed of piston stroke mechanism. The present invention includes a more convenient mechanism to adjust this length and speed of piston stroke. The mechanism includes a rotating barrel protruding around the outside diameter of the body of the impact power tool that may be turned for adjusting a floating tool-holder. This will alter the distance between the annular ring within the bore and the impact location of the piston. Adjusting how far the piston enters into the front chamber of the handpiece will determine how much pressure in the rear chamber is relieved on each piston forward stroke. The amount of pressure relived at the end of the forward stroke will determine the length of the return piston stroke and thus the overall power of the impacting tool. A rotating barrel around the outside of the tool will provide a tool that is more versatile and easily altered by the user to his or her liking.

It is also an object of this invention to provide a simplified mechanism to adjust the stroke length that is inexpensive to manufacture and assemble.

BRIEF DESCRIPTION OF THE DRAWINGS

Embodiments of the present invention are described below with reference to attached drawing figures, wherein.

DETAILED DESCRIPTION OF THE PREFERRED EMBODIMENT

Figure 1:
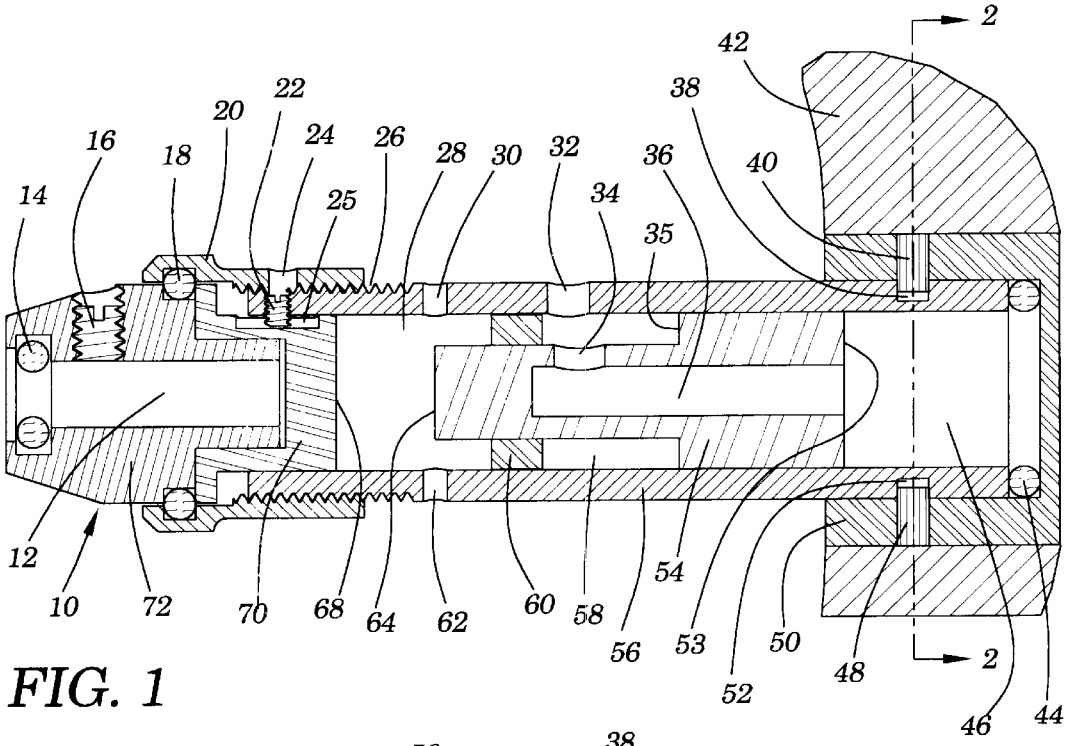
FIG. 1 is a perspective view of a hand-held impact power tool constructed in accordance with the present invention.

An impact handpiece 10, is illustrated in FIG. 1 that includes a body 56 with an outside diameter and inside diameter. A tool holder 72 is provided with a locking screw 16 that is used to tighten a tool tip (not shown) securely within the tool hole 12. An o-ring 14 is provided within the tool holder hole 12 that will permit tool tips to be inserted and removed quickly and yet provide some friction to prevent the tool tip from falling out if the user does not wish to use locking screw 16. This will permit tool tips to be changed more rapidly than by utilizing locking screw 16. Tool holder base 70 has a mating inside diameter that provides a press fit to tool tip holder 72. Between tool holder 72 and tool holder base 70 is an o-ring 18. This o-ring 18 provides a method for rotating barrel 20 to be held onto tool holder 72 and tool holder base 70 and yet let the rotating barrel 20 rotate axially around tool holder 72 and tool holder base 70. The outside diameter of one end of tool holder base 70 is a size that will permit it to slide easily within the inside diameter of body 56. Mating threads 26 are provided on the front end of the outside diameter of body 56 and on the inside diameter of rotating barrel 20. A slot 25 running axially on the outside diameter of tool holder base 70 is provided so that indexing screw 22 protruding through the body 56 may index and keep tool holder base 70 and tool holder 72 from rotating within the inside diameter of the body 56. Access hold 24 is provided though rotating barrel 20 for the purpose of access to indexing screw 22.

The impact handpiece 10 also includes within the inside diameter of the body 56 an annular shoulder 60 that is fixed in position and accommodates a two-step piston 54 that can move axially within the body inside diameter. The piston together with the annular shoulder divides the cavity into the following three chambers:

- a head chamber 28 defined by the tool holder end face 68, and one side of the annular shoulder 60. This head chamber constantly communicates with the atmosphere through exhaust ports 62 and 30;
- a central chamber 58 defined by the piston step end face 35 and one side of the annular shoulder 60. The central chamber constantly communicates with a compressed air source through intake port 32;
- a rear chamber 46 defined by the rear piston face 53 and a handle end cap 50. Depending on the position of the piston relative to the body, this rear chamber periodically communicates with the compressed air through passage 36, piston port 34, and intake port 32, or with the atmosphere through passage 36, piston port 34, and exhaust ports 62 and 30.

Figure 2:
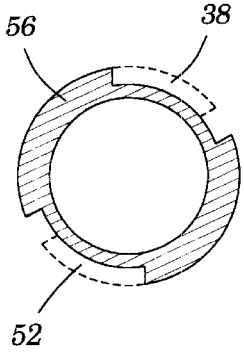
FIG. 2 is a sectional view taken along 2—2 of FIG. 1, but with the handle and end cap removed

A handle 42 is comfortably shaped to fit into the palm of the hand and to provide bottom clearance as the tool is used over the work. The handle 42 is permanently fixed onto an end cap 50. The end cap 50 attaches over the body 56 with an airtight seal. The attachment method includes pins 40 and 48 that are permanently fixed onto and protruding slightly into the inside diameter of the end cap 50. Two slots 38 and 52 are provided on the body 56. These two slots are the width of pins 40 and 48 providing a sliding fit. These slots run from the handle end of the body 56 a distance and then rotate a distance around the diameter. Slots 38 and 52 are illustrated in FIG. 2. Note: handle 42, end cap 50, and pins 40 and 48 have been removed from the illustrated sectional view in FIG. 2. To attach the handle 42 and end cap 50, users line up pins 40 and 48 with slots 38 and 52, the handle is pushed on and turned. End cap 50 is drawn on tightly against o-ring 44 creating an airtight seal.

Operation

During operation the air pressure to the impact handpiece is varied and controlled by the user with a foot control valve (not shown in the illustrations). This foot control is adjustable and influences air flow ranges from zero to potential flow from a supply source of pressurized air such as an air compressor. This foot control valve includes an inlet port that is communication with the supply source of pressurized air and also includes an outlet port that is communication with (referring to FIG. 1) impact handpiece 10 through intake port 32.

The hand-held pneumatic impact power tool operates as follows. Referring to FIG. 1, when compressed air is introduced to the intake port 32 and piston 54 is in a position illustrated in FIG. 1, compressed air will fill the central chamber 58 and also the rear chamber 46 via piston port 34 and passage 36. The air pressure in the central chamber will attempt to push the piston further to the rear of the internal cavity by pressing against the piston step end face 35, but the air pressure in the rear chamber 46 will attempt to push the piston in the opposite direction toward the front of the cavity by pressing against the rear piston face 53. Because the surface area of the rear piston face 53 is greater than the surface area of piston step end face 35, the piston will shift toward the front of the cavity until the front piston face 64 collides with tool holder end face 68, thus delivering an impact. While the piston was traveling toward the tool holder end face 68, piston port 34 for a short time was aligned with annular shoulder 60 and the compressed air from the central chamber was then shut off to piston port 34 and thus to the rear chamber 46. With continuing movement of the piston toward the tool holder end face 68, piston port 34 became in communication with head chamber 28 permitting the air pressure that was built up in the rear chamber 46 to be released into the atmosphere through passage 36 in the piston, to the head chamber 28, and finally out exhaust ports 62 and 30. With the piston in the front most position now illustrated in FIG. 3 and the air pressure released out of the rear chamber 46, the air pressure in the central chamber 58 pressing against the piston step end face 35 and together with an impacting recoil will shift the piston back to the rearward position illustrated in FIG. 1. With the piston in this rearward position, piston port 34 is now back in communication with central chamber 58 and air pressure from intake port 32. The air pressure will again build in rear chamber 46 through passage 36 and the process is repeated, thus oscillating the piston.

An idling ready-state of the impact handpiece is similar to what is described above except the piston oscillates with a very short movement stroke and without the front piston face 64 colliding or impacting with the tool holder end face 68. This idling state can be achieved with very short movement strokes because piston port 34 is the same width as the annular shoulder 60. With this configuration the piston port 34 can move a very short distance to either side from alignment with the annular shoulder 60 for receiving and exhausting sufficient air pressure to oscillate the piston. The air pressure and airflow required for this idling oscillation are very low.

Figure 3:
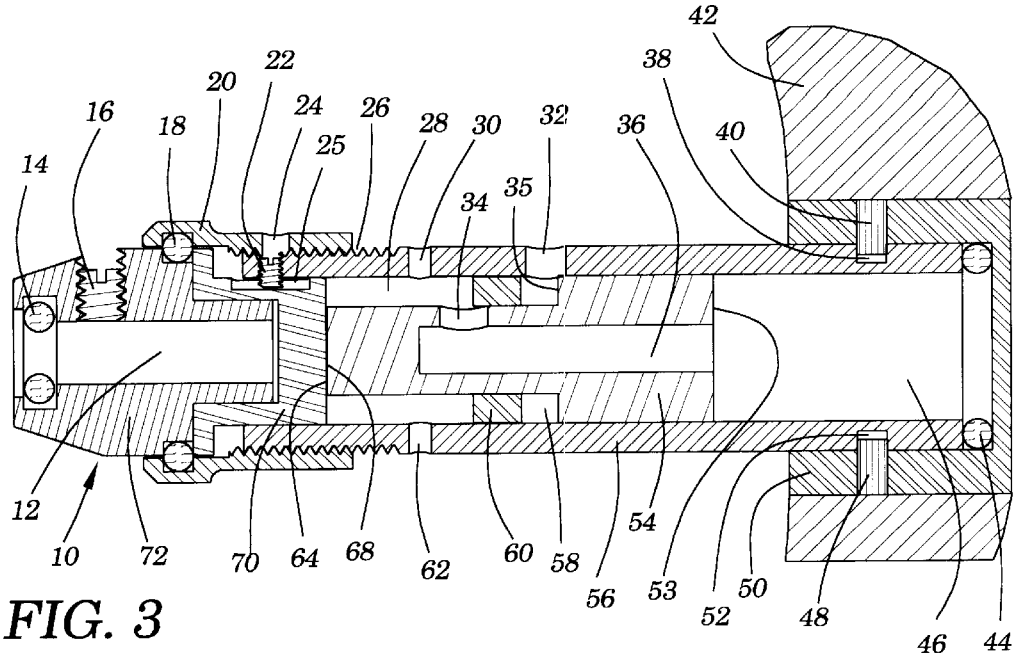
FIG. 3 is the same view as FIG. 1, differing in that the piston is occupying a forward position.
Figure 4:
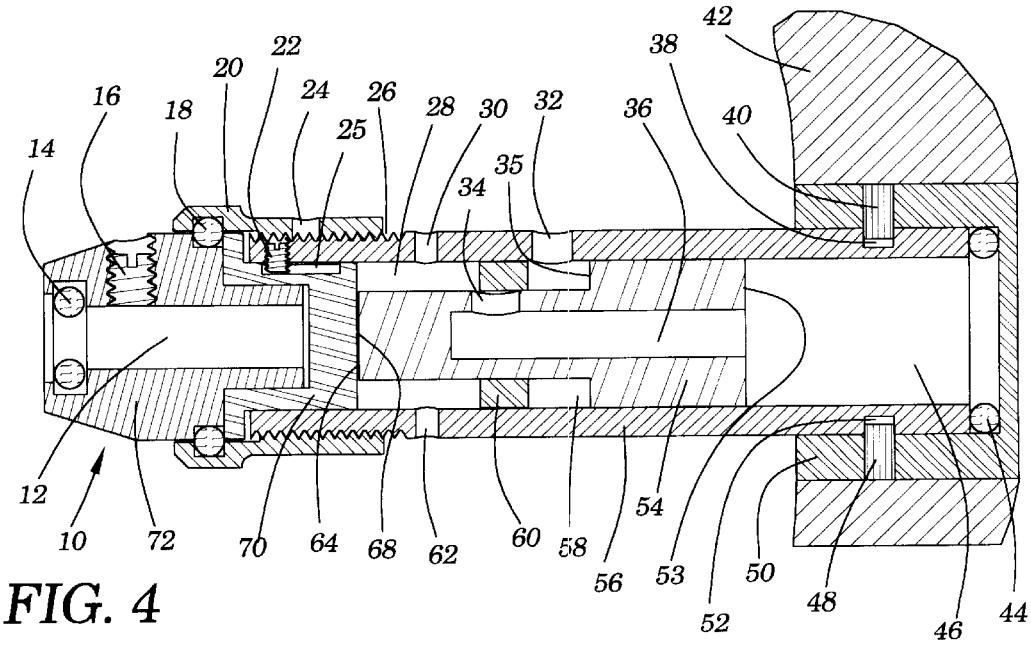
FIG. 4 is the same view as FIG. 1, differing in that the length of stoke rotating barrel is adjusted to the shortest stroke and the piston is occupying a forward position.
Figure 5:
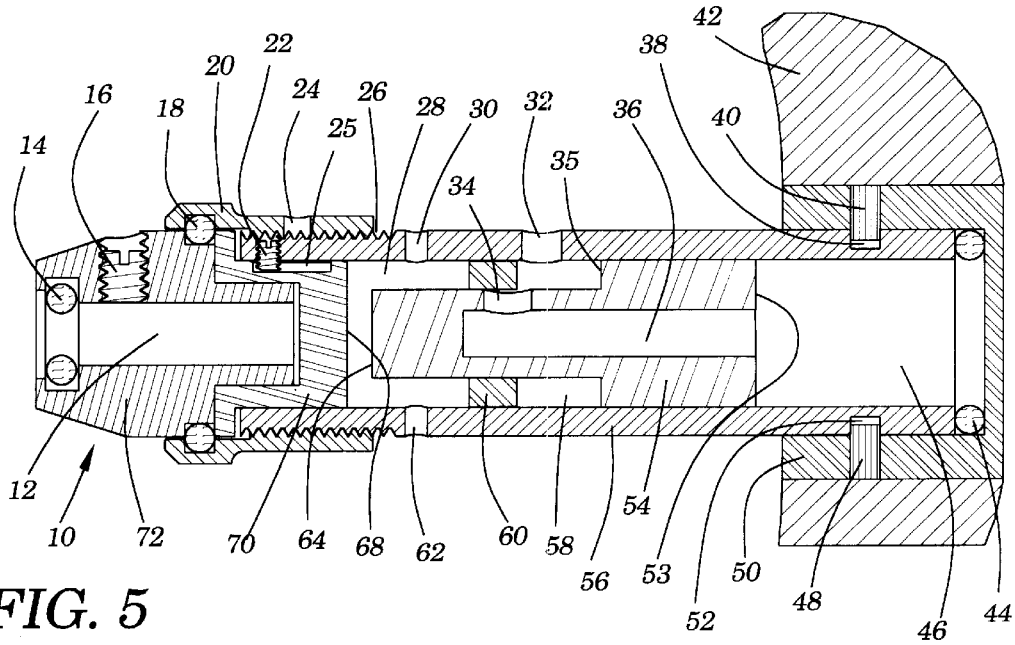
FIG. 5 is the same view as FIG. 4, differing in that the piston is occupying a rearward position.
Figure 6:
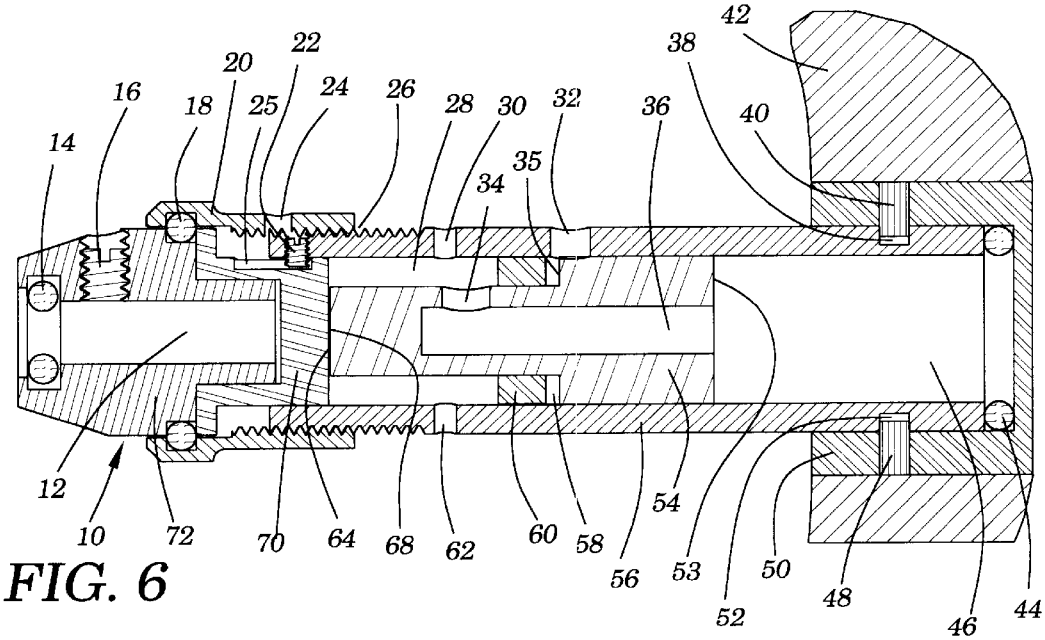
FIG. 6 is the same view as FIG. 1, differing in that the length of stoke rotating barrel is adjusted to the longest stroke and the piston is occupying a forward position.
Figure 7:
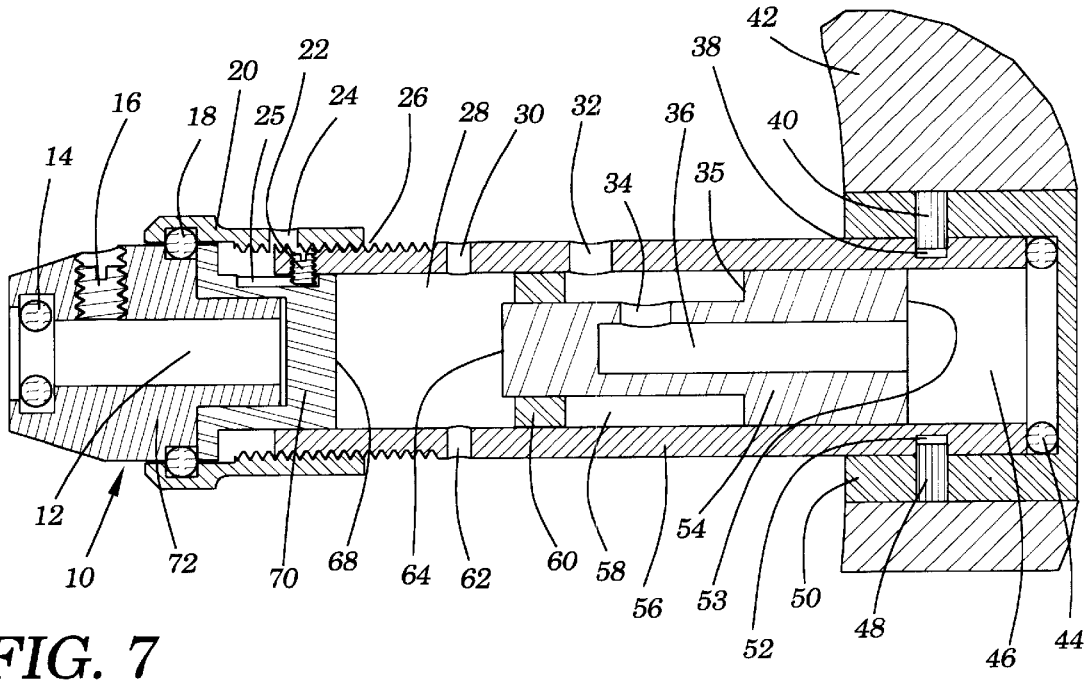
FIG. 7 is the same view as FIG. 6, differing in that the piston is occupying a rearward position.

The impacting characteristics of the impact handpiece can be altered by the jeweler or engraver by adjusting the rotating barrel 20. When the user turns the rotating barrel 20 the tool holder base 70 and tool holder 72 are slid along the axis of the handpiece. With indexing screw 22 protruding through the body 56 and into slot 25 located on tool holder base 70 the tool holder base 70 and tool holder 72 are prevented from rotating with the barrel, although tool holder base 70 and tool holder 72 may slide axially in and out within the permitting length range of slot 25. Moving the location of tool holder end face 68 in this way will move the location of where the piston impacts tool holder end face 68. In this way it is possible to adjust the speed that the piston impacts occur and the length of the return strokes, which will affect the overall impact power range of the handpiece. Referring to FIG. 6, by adjusting rotating barrel 20 and thus the tool holder end face 68 frontward (away from handle 42) and having piston 54 in its front most position (i.e. making an impact), the piston port 34 opening will be positioned further into head chamber 28 creating a larger passage for air pressure in the rear chamber 46 to escape into the atmosphere. Lowering as much pressure as possible in the rear chamber 46 with the piston in this position allows the piston to travel further back in the return stroke (FIG. 7). Longer return strokes are helpful in delivering harder impact strokes since the piston has more time to accelerate to a greater velocity during the impact stroke. In addition these longer impact strokes take more time to cycle, thus the strokes per minute slow down when adjusting the rotating barrel 20 in the direction just described. Referring to FIG. 4, when rotating barrel 20 is adjusted in the opposite direction than just described so that tool holder end face 68 is moved rearward (towards handle 42) and having piston 54 in its front most position (i.e. making an impact), piston port 34 will now be positioned not as far into head chamber 28, creating a smaller passage for air pressure in the rear chamber 46 to escape into the atmosphere. Since not as much air pressure can escape from rear chamber 46, the return stroke of the piston will not return as far into rear chamber 46 (FIG. 5). This effect will give the tool shorter and less hard impacts over all air pressure ranges and the piston will in addition oscillate faster when impacting. Being able to adjust the tool holder end face 68 by simply turning rotating barrel 20 and thus altering the overall impact power range together with the impact speed of the tool makes the feature user friendly. Jewelers and engravers can easily and quickly adjust this feature to their work requirements. FIGS. 1 and 3 illustrate the tool set at a medium stroke length. FIGS. 4 and 5 illustrate the tool set at a short stroke length. FIGS. 6 and 7 illustrate the tool set at a long stroke length.

O-ring 18 is used to fasten the tool holder together with rotating barrel 20 but o-ring 18 has an added benefit of permitting the tool holder to float within the resilient range of the o-ring material. That is, this o-ring is elastomeric and provides isolation that suspends or floats the tool holder longitudinally a distance during a piston impact and returns to its original position between impacts. This additional benefit of o-ring 14 will reduce vibration to the body 56 and thus vibration to the users' hand during operation.

CONCLUSION, RAMIFICATIONS, AND SCOPE

Accordingly, the reader will see that the hand-held pneumatic impact tool provides a unique feature for helping the jeweler or engraver carry out his work more easily and quickly. The invention has advantages in that it provides an easily adjusted mechanism for users to adjust the length of piston stroke and impact speed of a hand-held impact power tool. The mechanism provides a rotating barrel protruding around the outside diameter of the body of the power tool that may be turned for adjusting the impact location, the porting and therefore the impacting characteristics of the impacting piston.

Although the invention has been described with reference to the illustrated preferred embodiment, it is noted that equivalents may be employed and substitutions made herein without departing from the scope of the invention as recited in the claims. For example:

One or more intake ports 32, piston ports 34, exhaust ports 62 and 30, setscrews 16 or 22, or slots 22 may be substituted over the number of those illustrated in the preferred embodiment.

An equivalent may be employed by eliminating the rotating barrel 20 and attaching in its place a slide that does not use threads but that is used by pushing it longitudinally along the handpiece axis. This slide may be a band totally around the diameter of the body, partially around the body, or just a protrusion in one place on the body.

Accordingly, the scope of the invention should be determined not by the embodiments illustrated, but by the appended claims and their legal equivalents.

I claim:

1. A hand-held pneumatic impact power tool for use in hand working operations for use with a supply of pressurized air, comprising:

a body containing a bore and having first and second ends, the bore having a central longitudinal axis;

a piston received within said bore and being shiftable relative to the body along the longitudinal axis;

a tool tip holder received within said bore and being shiftable relative to said body along the longitudinal axis of said body;

an oscillation means by which said piston will oscillate under the action of said supply of pressurized air;

a piston impacting location within said body;

an adjustable element protruding from said body; when said adjustable element is adjusted it will cause said tool tip holder and said piston impacting location to move along the longitudinal axis of said body within said bore.

2. A hand-held pneumatic impact power tool as recited in claim 1, wherein said adjustable element is in the form of an annular ring around said body and having a central longitudinal axis extending in a parallel direction with the central longitudinal axis of said body, said adjustable element being rotatable around its own longitudinal axis and around said body.

3. A hand-held pneumatic impact power tool as recited in claim 1, further comprising:

a support means for providing friction-fit engagement between a tool tip and said tool tip holder sufficient to retain the tool tip and yet to permit manual removal of the tool tip.

4. A hand-held pneumatic impact power tool as recited in claim 1, further comprising:

a handle containing a receiving-recess extending in a direction parallel with the central longitudinal axis of said bore; and a handle-attachment means to permit manual removal and installing of said handle, said handle-attachment means includes more than one pin positioned a distance into said receiving-recess, said handle-attachment means includes more than one groove on the outside diameter of said second end and running from said second end for a distance and in a direction substantially parallel with the central longitudinal axis of said body and then changes direction and rotates around the central longitudinal axis of said body a distance.

5. A hand-held pneumatic impact power tool for use in hand working operations for use with a supply of pressurized air, comprising:

a body containing a bore and having first and second ends, the bore having a central longitudinal axis;

a piston received within said bore and being shiftable relative to the body along the longitudinal axis;

an impacting location within the longitudinal axis of said bore;

an adjustable element protruding from said body, that when adjusted will alter said impacting location of said piston within said body;

an oscillation means by which said piston will oscillate under the action of said supply of pressurized air; and a foot-operated flow control valve including an inlet port in communication with said supply of pressurized air and an outlet port, said foot-operated flow control valve is movable between an off position in which the air flow is zero and a number of on positions in which the air flow ranges from zero to the pressure of said supply of pressurized air.

6. A hand-held pneumatic impact power tool as recited in claim 5, further comprising:

an annular band located around said body and having a central longitudinal axis extending in a parallel direction with the central longitudinal axis of said body, said annular band being rotatable around its own longitudinal axis and around said body.

7. A hand-held pneumatic impact power tool as recited in claim 5, further comprising:

an anvil received within said bore at the first end of the body.

8. A hand-held pneumatic impact power tool as recited in claim 5, further comprising:

an anvil received within said bore at the first end of the body, said anvil including a recess extending in a direction substantially parallel with the central longitudinal axis of said bore so as to define a receptacle in the anvil;

a support means for providing friction-fit engagement between a tool tip and said anvil sufficient to retain the tool tip in said receptacle and to permit manual removal of the tool tip.

9. A hand-held pneumatic impact power tool as recited in claim 5, further comprising:

a handle containing a receiving-recess extending in a direction parallel with the central longitudinal axis of said bore; and a handle-attachment means to permit manual removal and installing of said handle, said handle-attachment means includes more than one pin positioned a distance into said receiving-recess, said handle-attachment means includes more than one groove on the outside diameter of said second end and running from said second end for a distance and in a direction substantially parallel with the central longitudinal axis of said body and then changes direction and rotates around the central longitudinal axis of said body.

10. A hand-held pneumatic impact power tool as recited in claim 5, wherein said adjustable element is in the form of an annular ring around said body and having a central longitudinal axis extending in a parallel direction with the central longitudinal axis of said body, said adjustable element being rotatable around its own longitudinal axis and around said body.

11. A hand-held pneumatic impact power tool for use in delicate hand working operations for use with a supply of pressurized air, comprising:

a body containing a bore and having first and second ends, said bore having a central longitudinal axis;

a piston received within said bore and being shiftable relative to the body along the longitudinal axis;

an oscillation means by which said piston will oscillate under the action of said supply of pressurized air;

a foot-operated flow control valve including an inlet port in communication with said supply of pressurized air and an outlet port, said foot-operated flow control valve is movable between an off position in which the air flow is zero and a number of on positions in which the air flow ranges from zero to the pressure of said supply of pressurized air;

an annular band located around said body and having a central longitudinal axis extending in a parallel direction with the central longitudinal axis of said body, said annular band being rotatable around its own longitudinal axis and around said body, an adjustable impact location that when adjusted will move the impact location longitudinally along the axis of said body, said adjustable impact location and said annular band in communication with each other in such a way that when said annular band is rotated it will adjust said impact location.

12. A hand-held pneumatic impact power tool as recited in claim 11, further comprising:

an anvil received within said bore at the first end of the body, said anvil including a recess extending in a direction substantially parallel with the central longitudinal axis of said bore so as to define a receptacle in the anvil;

a support means for providing friction-fit engagement between a tool tip and said anvil sufficient to retain the tool tip in said receptacle and to permit manual removal of the tool tip.

13. A hand-held pneumatic impact power tool as recited in claim 11, further comprising: an anvil received within said bore.

14. A hand-held pneumatic impact power tool as recited in claim 13, further comprising:

said anvil being shiftable along the longitudinal axis of said body; and when said annular band is rotated will cause said anvil to move along the longitudinal axis of said bore.

15. A hand-held pneumatic impact power tool as recited in claim 11, further comprising:

a handle containing a receiving-recess extending in a direction parallel with the central longitudinal axis of said bore; and a handle-attachment means to permit manual removal and installing of said handle, said handle-attachment means includes more than one pin positioned a distance into said receiving-recess, said handle-attachment means includes more than one groove on the outside diameter of said second end and running from said second end for a distance and in a direction substantially parallel with the central longitudinal axis of said body and then changes direction and rotates around the central longitudinal axis of said body.

* * * * *